US007991307B2

(12) United States Patent
Kneisel et al.

(10) Patent No.: US 7,991,307 B2
(45) Date of Patent: Aug. 2, 2011

(54) MEDIA ELEVATOR'S CURRENT POSITION IDENTIFICATION METHOD AND A MEDIA HANDLING DEVICE ARRANGED WITH THE SAME

(75) Inventors: Charles S. Kneisel, Farmington, NY (US); Paul S. Bonino, Ontario, NY (US); Douglas K. Herrmann, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 451 days.

(21) Appl. No.: 11/782,232

(22) Filed: Sep. 24, 2007

(65) Prior Publication Data

US 2009/0080918 A1 Mar. 26, 2009

(51) Int. Cl.
*G03G 15/00* (2006.01)

(52) U.S. Cl. ..... 399/16; 399/23

(58) Field of Classification Search ..... 399/12, 399/8, 9, 23, 393, 16, 381
See application file for complete search history.

(56) References Cited

U.S. PATENT DOCUMENTS

| | | | | |
|---|---|---|---|---|
| 4,227,683 | A * | 10/1980 | Spangler et al. | 493/10 |
| 4,589,645 | A * | 5/1986 | Tracy | 271/3.03 |
| 4,955,854 | A * | 9/1990 | Roth | 225/103 |
| 5,165,678 | A * | 11/1992 | Koseki et al. | 271/157 |
| 5,556,252 | A * | 9/1996 | Kuster | 414/796.7 |
| 6,186,492 | B1 * | 2/2001 | Dechau et al. | 271/30.1 |
| 6,236,816 | B1 | 5/2001 | Warbus et al. | |
| 6,264,188 | B1 * | 7/2001 | Taylor et al. | 271/98 |
| 6,695,305 | B2 * | 2/2004 | Muller et al. | 271/152 |
| 7,010,236 | B2 | 3/2006 | Shinkawa et al. | |
| 7,387,297 | B2 * | 6/2008 | Moore | 271/10.11 |
| 2002/0074714 | A1 * | 6/2002 | Yow et al. | 271/162 |
| 2002/0195768 | A1 * | 12/2002 | Yamakawa et al. | 271/213 |
| 2003/0095811 | A1 * | 5/2003 | Haines | 399/84 |
| 2006/0193644 | A1 * | 8/2006 | Takagi | 399/12 |
| 2008/0138098 | A1 * | 6/2008 | Wegman et al. | 399/12 |
| 2008/0193165 | A1 * | 8/2008 | Nakazawa et al. | 399/167 |
| 2008/0298820 | A1 * | 12/2008 | Sugiura | 399/12 |
| 2010/0013143 | A1 * | 1/2010 | Baena et al. | 271/18 |

FOREIGN PATENT DOCUMENTS

JP 2006056079 A * 3/2006

* cited by examiner

*Primary Examiner* — Quana M Grainger
(74) *Attorney, Agent, or Firm* — Gibb I.P. Law Firm, LLC

(57) ABSTRACT

A media handling device includes sensing means disposed in a media elevator that is movable in a generally-vertical travel path proximate to a generally-fixed surface. The sensing means detects a recorded information that is disposed in the surface. The resulting detected information is used to identify the media elevator's current position. Also, another media handling device includes a recorded information disposed in a movable media elevator. Sensing means are fixed proximate to a generally-vertical media elevator travel path. The recorded information is sensed and the resulting detected information is used to identify the media elevator's current position.

27 Claims, 4 Drawing Sheets

MEDIA ELEVATOR'S CURRENT POSITION IDENTIFICATION METHOD AND A MEDIA HANDLING DEVICE ARRANGED WITH THE SAME

INCORPORATION BY REFERENCE OF OTHER PATENTS

The disclosures of the following two (2) U.S. Patents in their entirety hereby are totally incorporated herein by reference:

U.S. Pat. No. 7,010,236 B2, issued to Kohji Shinkawa et al., granted 7 Mar. 2006, entitled "Equipment unit with imperceptible information recorded thereon being used with an image forming device and an image forming device comprising the same"; and U.S. Pat. No. 6,236,816 B1, issued to Volker Warbus et al., granted 22 May 2001, entitled "Printing or duplicating apparatus optionally operating with magnetic or non magnetic toner".

BACKGROUND OF THE INVENTION

Media handling devices such as finishing devices and feeders are known. In current finishing devices and feeders, various methods are used to identify and control the media elevator's current position.

Current methods involve three (3) photoelectric optical or "light" sensors. A first "comb" sensor and a second "limit" sensor are mounted on the elevator itself. A third "full" sensor is mounted near the elevator's bottom or "paper full" position.

The comb and limit elevator sensors, in turn, are arranged to detect two patterns of holes or notches that are fabricated in a metal bracket that is fixed near the elevator travel path. While the bracket solid areas prevent light transmission, the opposing bracket hole or notch areas allow light transmission. Hence, the comb and limit sensors are readily able to detect these bracket hole or notch patterns.

The comb sensor detects the elevator's movement by sensing a "comb"-like pattern of intermittent protruding bracket fingers. Thus, as the elevator travels between the top and bottom positions, the comb sensor traverses the intermittent bracket fingers. As the comb sensor traverses a bracket finger area, the bracket finger prevents light transmission and the comb sensor output turns "off". Conversely, when the comb sensor traverses a gap between adjacent bracket fingers, the gap area, being free air, allows light transmission and the comb sensor output turns "on". Hence the comb sensor detects elevator movement by sensing alternating intermittent "on" and "off" light patterns while traversing bracket fingers.

The limit sensor detects the elevator's top-limit and bottom-limit positions by sensing two holes or "notches" fabricated in the bracket top and bottom end regions. The top-limit position is detected by the limit sensor detecting the bracket top notch. The bottom-limit position is detected when the limit sensor detects the bracket bottom notch and the "full" sensor detects an elevator protruding "flag" member that prevents light transmission in the elevator's bottom-limit position.

These present methods further utilize various algorithms to determine elevator position and direction. These methods require the elevator to initialize (home) at some position which is usually at the top or bottom of travel. They measure position in the middle of travel by counting from the home position using stepper motor steps or sensor steps using a linear encoder. Often this process requires the elevator to travel to the bottom (or top) of its range to home, and then the desired intermediate position during printer cycle up. This method takes a long time and can be costly depending on its complexity.

Thus, there is a need for the present invention.

SUMMARY OF THE INVENTION

In a first aspect of the invention, there is provided a method to identify a media elevator's current position in a media handling device, the media handling device including a sensor disposed in a media elevator that is movable in a generally-vertical travel path proximate to a generally-fixed surface, the method comprising the sensor detecting a recorded information that is disposed in the surface thus forming a detected information and identifying the media elevator's current position based on the detected information.

In a second aspect of the invention, there is provided a method to identify a media elevator's current position in a media handling device, the media handling device including a recorded information disposed in an included movable media elevator, the method comprising the recorded information being detected by one or more sensors that are fixed proximate to a generally-vertical media elevator travel path thus forming a detected information and identifying the media elevator's current position based on the detected information.

In a third aspect of the invention, there is provided a media handling device including media elevator's current position identifying sensing means disposed in an included media elevator, the media elevator movable in a generally-vertical travel path proximate to a generally-fixed surface that includes a recorded information disposed therein, the recorded information sensed to form a detected information which, in turn, is used by included processing means to identify the media elevator's current position.

In a fourth aspect of the invention, there is provided a media handling device including a recorded information disposed in an included movable media elevator, further including media elevator's current position identifying sensing means fixed proximate to a generally-vertical media elevator travel path, the recorded information being arranged to be sensed to form a detected information which, in turn, is used by included processing means to identify the media elevator's current position.

BRIEF DESCRIPTION OF THE SEVERAL VIEWS OF THE DRAWING

FIG. 1 shows in solid lines the media elevator 1 as being disposed in its top position 8.9. Conversely, FIG. 1 also shows in broken lines the media elevator (depicted by reference number 1') as being disposed in its bottom position 8.1.

FIG. 6 shows in solid lines the media elevator 101 as being disposed in its top position 8.9. Conversely, FIG. 6 also shows in broken lines the media elevator in broken lines (depicted by reference number 101') as being disposed in its bottom position 8.1.

DETAILED DESCRIPTION OF THE INVENTION

Briefly, in accordance with the present invention, a media handling device includes sensing means disposed in a media elevator that is movable in a generally-vertical travel path proximate to a generally-fixed surface. The sensing means detects a recorded information that is disposed in the surface. The resulting detected information is used to identify the media elevator's current position with respect to the media elevator travel path. Also, another media handling device includes a recorded information disposed in a movable media elevator. Sensing means are fixed proximate to a generally-vertical media elevator travel path. The recorded information is sensed and the resulting detected information is used to identify the media elevator's current position with respect to the media elevator travel path.

Figure 1:
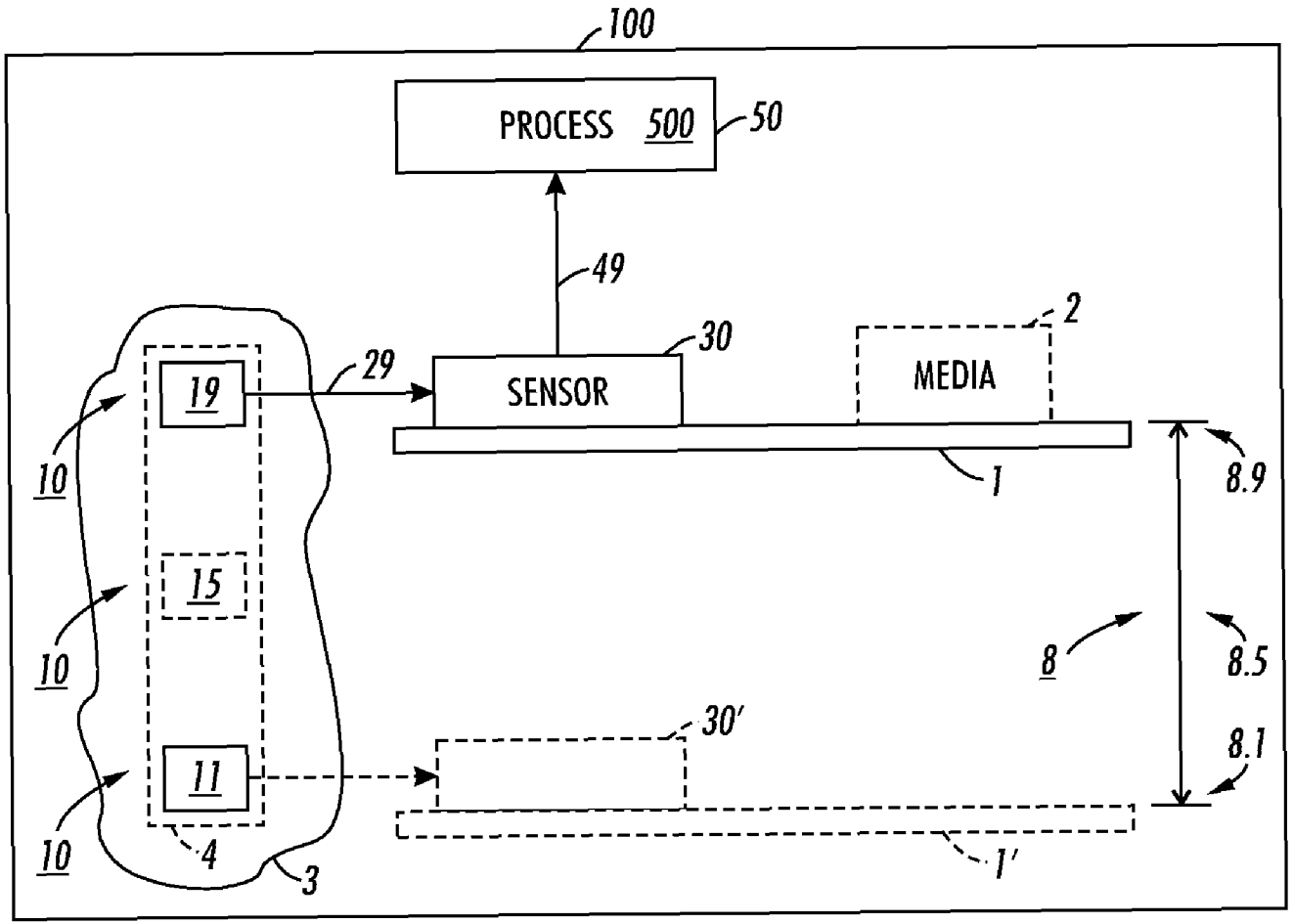
FIG. 1 depicts a media handling device 100 arranged in accordance with a first embodiment of a media elevator's current position identification method, in accordance with the present invention. As shown, the media handling device 100 includes a media elevator 1, a generally-fixed surface 3 with recorded information 10 disposed therein, a sensor 30 and a processing means 50. The sensor 30 is disposed in the media elevator 1. The media elevator 1 is movable in a generally-vertical travel path 8 proximate to the surface 3. The media elevator travel path 8 includes a bottom position 8.1, one or more intermediate positions 8.5 and a top position 8.9.

Referring now to FIG. 1, there is depicted a media handling device 100 arranged in accordance with a first embodiment of a media elevator's current position identification method or process 500, in accordance with the present invention. As shown, the media handling device 100 includes a sensor 30 that is disposed in a media elevator 1. In one embodiment a media stack 2 comprising one or more sheets of media is disposed on the media elevator 1.

The media elevator 1 is movable in a generally-vertical media elevator travel path 8. The media elevator travel path 8 includes a media elevator travel path bottom position 8.1, one or more media elevator travel path intermediate positions 8.5 and a media elevator travel path top position 8.9.

The media elevator travel path 8, in turn, is proximate to a generally-fixed surface 3.

In accordance with the present invention, the surface 3 includes a recorded information 10 that is arranged to be detected by the sensor 30 to identify the media elevator's current position with respect to the media elevator travel path 8.

As shown, in various embodiments the recorded information 10 includes a bottom position recorded information 11, one or more quanta of intermediate position recorded information 15 and a top position recorded information 19.

As shown in FIG. 1, the sensor 30 detects the recorded information 10 by means of a sensing signal 29. Based on detecting the recorded information 10, a sensor output 49 is provided to the processing means 50.

Figure 5:
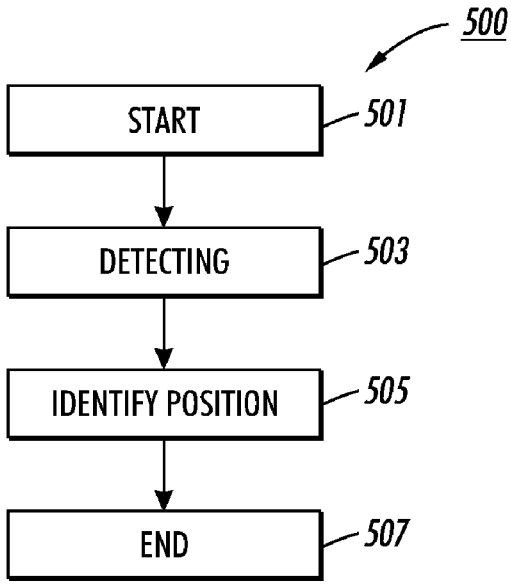
FIG. 5 depicts one embodiment 500 of a flow diagram for a media elevator's current position identification method or process, in accordance with the present invention. As shown, the process 500 comprises a first step 503 of detecting the recorded information 10 and a second step 505 of identifying the media elevator's current position.

In accordance with the present invention, the processing means 50 is constructed and arranged to perform the process 500 that is depicted in FIG. 5.

Referring now to FIG. 5, in step 503 a detected information is formed based on detecting the recorded information 10 by the sensor 30. Further, in step 505 the media elevator 1's current position in its travel path 8 is identified based on the detected information formed in step 503.

Referring again to FIG. 1, with continued cross-reference to FIG. 5, in various embodiments the process 500 identifies the media elevator 1's current position as being its bottom position 8.1 based on the sensor 30 detecting the bottom position recorded information 11.

Further, in various embodiments the process 500 identifies the media elevator 1's current position as being one or more of its intermediate positions 8.5 based on the sensor 30 detecting the one or more quanta of intermediate position recorded information 15.

Also, in various embodiments the process 500 identifies the media elevator 1's current position as being its top position 8.9 based on the sensor 30 detecting the top position recorded information 19.

Still referring to FIG. 1, in various embodiments the recorded information 10 includes one or more machine-detectable symbols.

Moreover, in various embodiments the machine-detectable symbols are arranged to be detected by any of magnetic signals, radio signals, infrared signals, machine vision, optical signals or ultrasonic signals.

Figure 2:
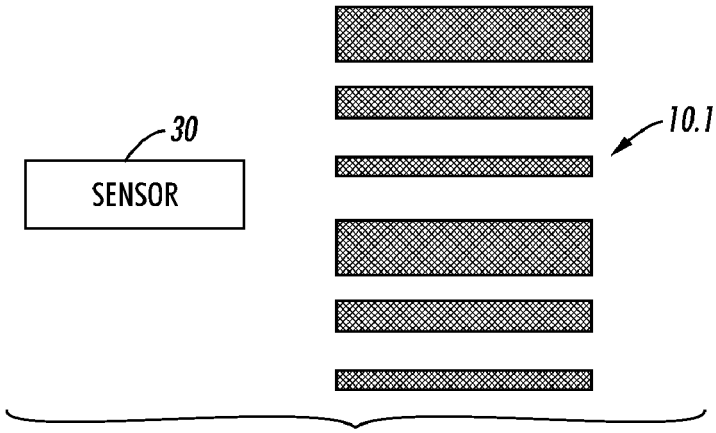
FIG. 2 depicts barcode symbols 10.1 and the sensor 30.

Further, in various embodiments the recorded information 10 comprises one or more barcode symbols such as, for example, the barcode symbols depicted in FIG. 2 as reference number 10.1.

Referring again to FIG. 1, in various embodiments the barcode symbols 10.1 comprise a barcode array 4. As shown, in one embodiment the barcode array 4 includes a bottom position barcode pattern 11 that is used by the process 500 to identify the media elevator 1's current position as being its bottom position 8.1.

Also, in various embodiments the barcode array 4 further includes one or more media elevator intermediate position barcode patterns 15 that are used by the process 500 to identify the media elevator 1's current position as being one or more of its intermediate positions 8.5.

Moreover, in various embodiments the array 4 further forms a top position barcode pattern 19 that is used by the process 500 to identify the media elevator's current position as being its top position 8.9.

Figure 6:
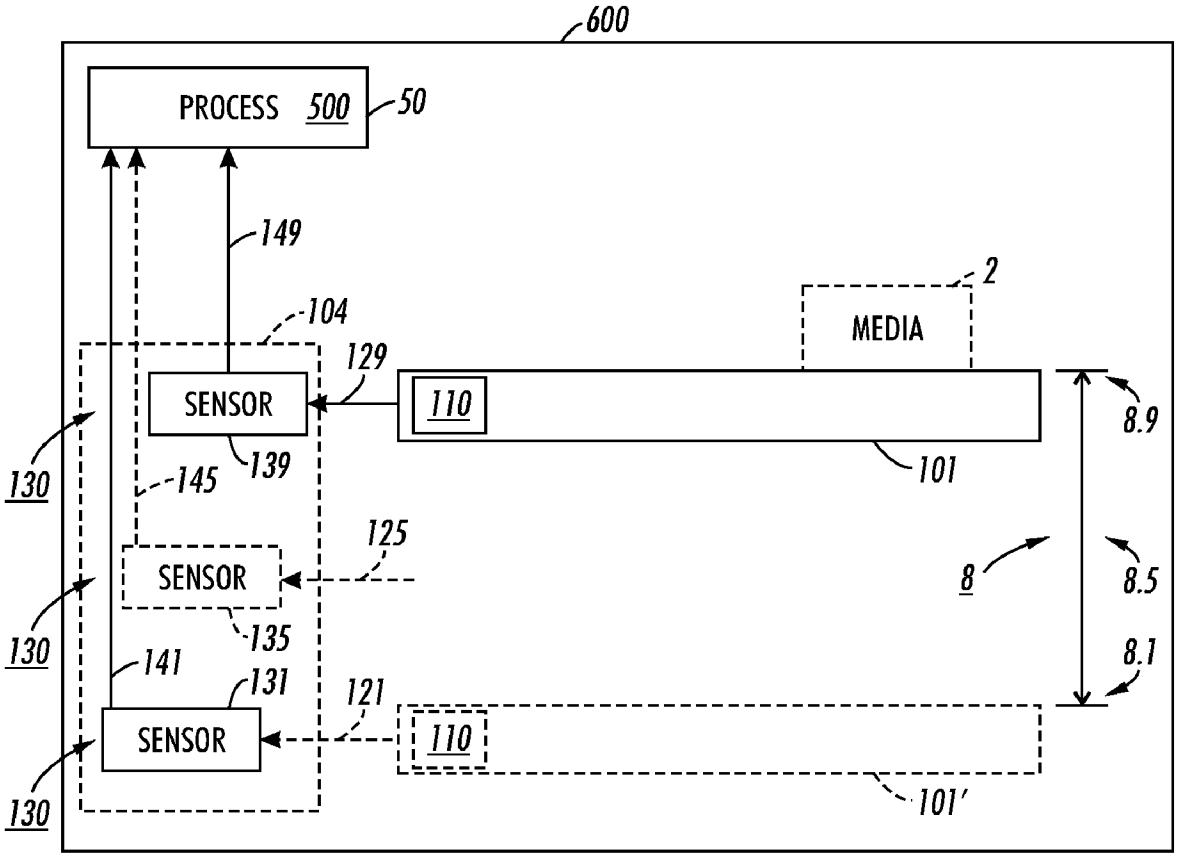
FIG. 6 depicts a media handling device 600 arranged in accordance with a second embodiment of a media elevator's current position identification method, in accordance with the present invention. As shown, the media handling device 600 includes a media elevator 101 with recorded information 110 disposed therein, one or more sensors 130 and a processing means 50. The media elevator 101 is movable in a generally-vertical travel path 8. The media elevator travel path 8 includes a bottom position 8.1, one or more intermediate positions 8.5 and a top position 8.9.

Referring now to FIG. 6 there is depicted a media handling device 600 arranged in accordance with a second embodiment of a media elevator's current position identification method, in accordance with the present invention.

As shown, the media handling device 600 includes a recorded information 110 that is disposed in a media elevator 101. In one embodiment a media stack 2 comprising one or more sheets of media is disposed on the media elevator 101.

The media elevator 101 is movable in a generally-vertical media elevator travel path 8. The media elevator travel path 8 includes a media elevator travel path bottom position 8.1, one or more media elevator travel path intermediate positions 8.5 and a media elevator travel path top position 8.9.

In accordance with the present invention, the media elevator 101 includes a recorded information 110 that is arranged to be detected by one or more included sensors 130 to identify the media elevator's current position with respect to the media elevator travel path 8.

As shown in FIG. 6 in various embodiments, the one or more sensors 130 are arranged in a sensor array 104.

Still referring to FIG. 6, in various embodiments the one or more sensors 130 includes a bottom position sensor 131, one or more intermediate position sensors 135 and a top position sensor 139.

As shown in FIG. 6, the bottom position sensor 131 detects the recorded information 110 by means of a first sensing signal 121. Based on detecting the recorded information 110, a first sensor output 141 is provided to the processing means 50.

Also as shown in FIG. 6, the one or more intermediate position sensors 135 detects the recorded information 110 by means of a second sensing signal 125. Based on detecting the recorded information 110, a second sensor output 145 is provided to the processing means 50.

Also as shown in FIG. 6, the top position sensor 139 detects the recorded information 110 by means of an additional sensing signal 129. Based on detecting the recorded information 110, an additional sensor output 149 is provided to the sensing means 50.

In accordance with the present invention, the processing means 50 is constructed and arranged to perform the process 500 as depicted in FIG. 5.

Referring now to FIG. 5, in step 503 a detected information is formed based on detecting the recorded information 110 by the one or more sensors 130. Further, in step 505 the media elevator 101's current position in its travel path 8 is identified based on the detected information formed in step 503.

Referring again to FIG. 6, with continued cross-reference to FIG. 5, in various embodiments the process 500 identifies the media elevator 101's current position as being its bottom position 8.1 based on the bottom position sensor 131 detecting 121 the recorded information 110.

Further, in various embodiments the process 500 identifies the media elevator 101's current position as being one or more of its intermediate positions 8.5 based on the one or more intermediate position sensors 135 detecting 125 the recorded information 110.

Also, in various embodiments the process 500 identifies the media elevator 101 current position as being its top position 8.9 based on the top position sensor 139 detecting 129 the recorded information 110.

Still referring to FIG. 6, in various embodiments the recorded information 110 includes one or more machine-detectable symbols.

Moreover, in various embodiments the machine-detectable symbols are arranged to be detected by any of magnetic signals, radio signals, infrared signals, machine vision, optical signals or ultrasonic signals.

Further, in various embodiments the recorded information 110 comprises one or more barcode symbols such as, for example, the barcode symbols depicted in FIG. 2 as reference number 10.1.

Referring again to FIG. 6, in various embodiments the barcode symbols 10.1 comprise a barcode array similar or identical to the barcode array 4 that is described above in connection with FIG. 1.

Referring now generally to FIGS. 1-6, the processing means 50 comprises any suitable means and apparatus for enabling the functions and processes as described herein.

In various embodiments, the recorded information 10 is arranged, configured and embodied to be detectable by the sensor 30.

Also in various embodiments, the recorded information 110 is arranged, configured and embodied to be detected by the one or more sensors 130.

In various embodiments, the various recorded information 10 and 110 comprise any one or more of barcodes, Q-codes, symbols, letters, numbers, characters, markings or other indicia that are capable of being detected by the media handling devices 100 and 600.

Still referring to FIGS. 1-6, in various embodiments the recorded information 10 and 110 are exclusively machine-detectable and thus not capable of being observed, perceived, detected, read, received or discerned by the human naked eye, and, conveying, transmitting, or representing Referring still to FIGS. 1-6, in addition and supplemental to being machine-detectable and machine-readable, in various embodiments the recorded information 10 and 110 are further arranged, configured and embodied also to be human detectable and thus visible to the human naked eye. In one embodiment, for example, the recorded information 10 and 110 comprise barcode symbols which barcode symbols are both, first, machine-detectable by a suitable barcode detecting means or software and, second, visible to and detectable by the human naked eye.

In various embodiments, the recorded information 10 and 110 comprise human-visible-and-machine-detectable markings, letters, numbers or symbols.

Still referring to FIGS. 1-6, in various embodiments the recorded information 10 and 110 are machine-detectable by the respective media handling devices 100 and 600 and, in addition, a portion, a part, a few, or some, though perhaps not totally all, of these same recorded information items 10 and 110 also are human detectable and thus visible to the human naked eye.

In one embodiment, for example, any of the recorded information 10 and 110 are based on the teachings of the aforementioned U.S. Pat. No. 7,010,236 B2, issued to Kohji Shinkawa et al., granted 7 Mar. 2006, entitled "Equipment unit with imperceptible information recorded thereon being used with an image forming device and an image forming device comprising the same" (hereinafter "Shinkawa"), the full, absolute and complete disclosure of which Shinkawa patent herein is incorporated by reference verbatim, and with the same effect as though such disclosure were hereinat presented and reproduced in its entirety. See, for example, Shinkawa from column 2, line 44 to column 4, line 20; and column 8, lines 3-7.

In one embodiment, for example, any of the recorded information 10 and 110 are based on magnetic ink character recognition ("MICR") technology, as described in the aforementioned U.S. Pat. No. 6,236,816 B1, issued to Volker Warbus et al., granted 22 May 2001, entitled "Printing or duplicating apparatus optionally operating with magnetic or non magnetic toner" (hereinafter "Warbus"), the full, absolute and complete disclosure of which Warbus patent herein is incorporated by reference verbatim, and with the same effect as though such disclosure were hereinat presented and reproduced in its entirety.

In one embodiment, for example, any of the recorded information 10 and 110 are based on the well-known and common Radio Frequency Identification ("RFID") tag technology.

In one embodiment, for example, any of the recorded information 10 and 110 are based on the well-known and common machine vision technology.

Still referring to FIGS. 1-6, in various embodiments any of the recorded information 10 and 110 comprise barcode symbols and the respective sensors 30 and 130 are arranged to detect the same.

Further, in various embodiments any of the recorded information 10 and 110 comprise machine-detectable symbols capable of being detected by magnetic signals and the respective sensors 30 and 130 are arranged to detect the same.

Also, in various embodiments any of the recorded information 10 and 110 comprise machine-detectable symbols capable of being detected by radio signals and the respective sensors 30 and 130 are arranged to detect the same.

Further, in various embodiments any of the recorded information 10 and 110 comprise machine-detectable symbols capable of being detected by infrared signals and the respective sensors 30 and 130 are arranged to detect the same.

Also, in various embodiments any of the recorded information 10 and 110 comprise machine-detectable symbols capable of being detected by machine vision signals and the respective sensors 30 and 130 are arranged to detect the same.

Further, in various embodiments any of the recorded information 10 and 110 comprise machine-detectable symbols capable of being detected by optical signals and the respective sensors 30 and 130 are arranged to detect the same.

Also, in various embodiments any of the recorded information 10 and 110 comprise machine-detectable symbols capable of being detected by ultrasonic signals and the respective sensors 30 and 130 are arranged to detect the same.

In one embodiment, a sensor that is commonly used for barcode sensing has the capability of triggering off alternating white and black bars (barcode strip). A custom barcode strip that may be used in conjunction with the sensor is mounted on the media elevator or the inner wall of the stacker/feeder such that it is opposite the sensor. As the media elevator moves, the bar code passes in front of the sensor and the output is monitored. As the media elevator is moving, the exact position of media elevator and direction of media elevator movement are known. This enables a more timely homing algorithm and cost reduction to existing solutions.

In one embodiment, the sensor has a single beam laser illumination at 45 degrees and detector at 0 degrees. The threshold for the sensor to change state is approximately 50% reflectance. White paper reflectance exceeds 80%, solid black print reflectance is typically less than 10%. FIG. 1 shows the sensor 30 mounted on the moving portion (tray) and barcode 10 on the inner wall of the stacker/feeder, so that barcode strip passes within its focal length of the sensor.

An alternate orientation, depicted in FIG. 6, is possible having the sensor 130 on the inner wall of the stacker/feeder and the barcode 110 on the paper tray.

Further to these embodiments, when the FIG. 1 sensor 30 or the FIG. 6 sensor 130 "sees" white, the output signal is low; the black strips cause a high signal.

Further to these embodiments, the most basic barcode strip is designed with 1 mm increments alternating white and black. It also has a specific code pattern at the bottom of travel and a different code pattern at the top of travel. Additional unique code patterns may be used for intermediate locations in the strip. While the tray is in motion, the monitoring circuit "reads" the sensor output and knows if the tray is at the top, bottom, or intermediate locations of travel, or moving in between. This eliminates the expensive "comb-like" metal brackets. Using intermediate bar code patterns allows a quicker home routine than present methods.

The barcode strip can be white label with printed black marks. Also, black marking could be silk screened directly on a metallic surface. Both options reduce cost and assembly complexity of the current methods.

An additional enhancement to this design is to use alternating width code strips to determine up/down direction of the tray. This is illustrated in FIGS. 2-4.

Thus, an example of a bar code that may determine the media elevator's direction of travel is depicted in FIG. 2.

Figure 3:
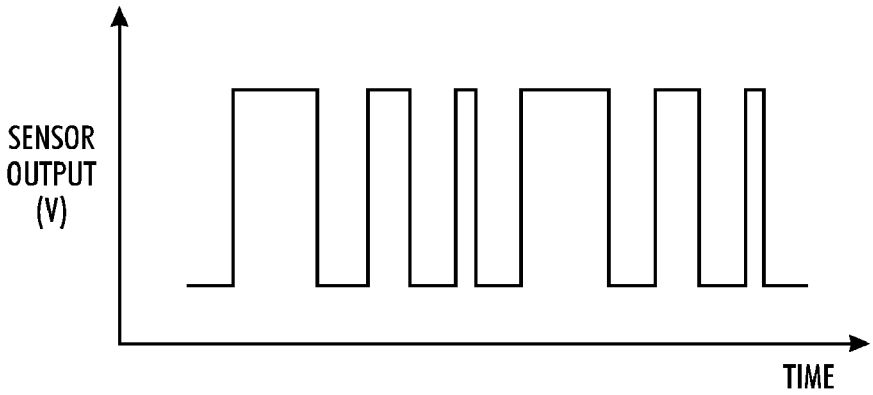
FIG. 3 depicts a first waveform of sensor 30 output voltage-versus-time.

Also, a bar code sensor output signal corresponding to the media elevator traveling in the down direction of FIG. 2 is depicted in FIG. 3.

Figure 4:
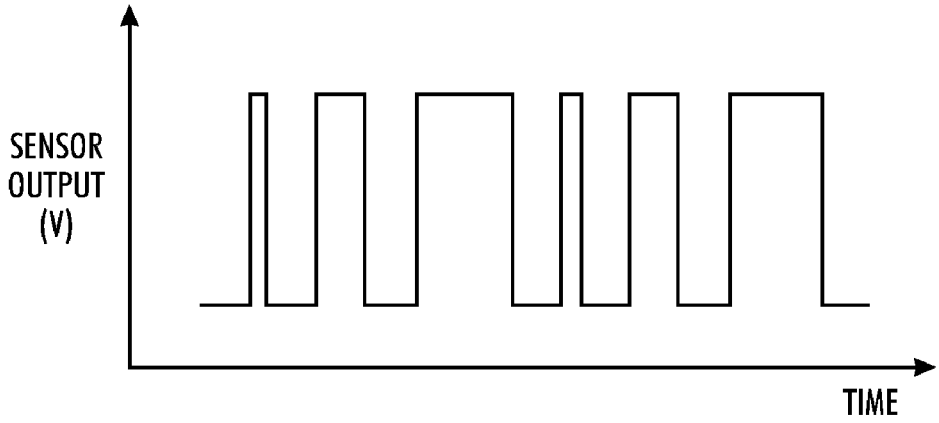
FIG. 4 depicts a second waveform of sensor 30 output voltage-versus-time.

Further, a bar code sensor output signal corresponding to the media elevator traveling in the up direction of FIG. 2 is depicted in FIG. 4.

Thus there is described the first aspect of the invention, namely, a method 500 to identify a media elevator's current position in a media handling device 100, the media handling device including a sensor 30 disposed in a media elevator 1 that is movable in a generally-vertical travel path 8 proximate to a generally-fixed surface 3, the method comprising the sensor 30 detecting 29 a recorded information 10 that is disposed in the surface 3 thus forming 503 a detected information and identifying 505 the media elevator's current position based on the detected information.

In a first variation of the first aspect, the recorded information 10 includes a bottom position recorded information 11 that is arranged to be used by the process 500 to identify the media elevator 1's current position as being an included bottom position 8.1.

In a second variation of the first aspect, the recorded information 10 includes a top position recorded information 19 that is arranged to be used by the process 500 to identify the media elevator 1's current position as being an included top position 8.9.

In a third variation of the first aspect, the recorded information 10 includes one or more quanta of intermediate position recorded information 15 that are arranged to be used by the process 500 to identify the media elevator 1's current position as being one or more included intermediate media elevator positions 8.5.

In a fourth variation of the first aspect, the recorded information 10 includes one or more machine-detectable symbols.

In a fifth variation of the first aspect, the machine-detectable symbols are arranged to be detected by any of magnetic signals, radio signals, infrared signals, machine vision, optical signals or ultrasonic signals.

In a sixth variation of the first aspect, the recorded information 10 comprises one or more barcode symbols 10.1.

In a seventh variation of the first aspect, the barcode symbols 10.1 comprise a barcode array 4, the barcode array 4 including a bottom position barcode pattern 11 that is arranged to be used by the process 500 to identify the media elevator 1's current position as being an included bottom position 8.1.

In an eighth variation of the first aspect, the barcode array 4 further includes a top position barcode pattern 19 that is arranged to be used by the process 500 to identify the media elevator 1's current position as being an included top position 8.9.

In a ninth variation of the first aspect, the barcode array 4 further includes one or more intermediate position barcode patterns 15 that are arranged to be used by the process 500 to identify the media elevator 1's current position as being one or more included intermediate positions 8.5.

Also, there is described the second aspect of the invention, namely, a method 500 to identify a media elevator's current position in a media handling device 600, the media handling device including a recorded information 110 disposed in an included movable media elevator 101, the method comprising the recorded information being detected by one or more sensors 130 that are fixed proximate to a generally-vertical media elevator travel path 8 thus forming 503 a detected information and identifying 505 the media elevator's current position based on the detected information.

In a first variation of the second aspect, the one or more sensors 130 includes a bottom position sensor 131 that is arranged to be used by the process 500 to identify the media elevator 101's current position as being an included bottom position 8.1.

In a second variation of the second aspect, the one or more sensors 130 includes a top position sensor 139 that is arranged to be used by the process 500 to identify the media elevator 101's current position as being an included top position 8.9.

In a third variation of the second aspect, the one or more sensors 130 includes one or more intermediate position sensors 135 that are arranged to be used by the process 500 to identify the media elevator 101's current position as being one or more included intermediate positions 8.5.

Also, there is described the third aspect of the invention, namely, a media handling device 100 including media elevator's current position identifying sensing means 30 disposed in an included media elevator 1, the media elevator movable in a generally-vertical travel path 8 proximate to a generally-fixed surface 3 that includes a recorded information 10 disposed therein, the recorded information sensed to form 503 a detected information which, in turn, is used by included processing means 50 to identify 505 the media elevator's current position.

In a first variation of the third aspect, the recorded information 10 includes a bottom position recorded information 11 that is arranged to be used by the process 500 to identify the media elevator 1's current position as being an included bottom position 8.1.

In a second variation of the third aspect, the recorded information 10 includes a top position recorded information 19 that is arranged to be used by the process 500 to identify the media elevator 1's current position as being an included top position 8.9.

In a third variation of the third aspect, the recorded information 10 includes one or more quanta of intermediate position recorded information 15 that are used by the process 500 to identify the media elevator 1's current position as being one or more included intermediate positions 8.5.

In a fourth variation of the third aspect, the recorded information 10 includes one or more machine-detectable symbols.

In a fifth variation of the third aspect, the machine-detectable symbols are arranged to be detected by any of magnetic signals, radio signals, infrared signals, machine vision, optical signals or ultrasonic signals.

In a sixth variation of the third aspect, the recorded information 10 comprises one or more barcode symbols 10.1.

In a seventh variation of the third aspect, the barcode symbols 10.1 are arranged to form a barcode array 4, the barcode array 4 including a bottom position barcode pattern 11 that is arranged to be used by the process 500 to identify the media elevator 1's current position as being an included bottom position 8.1.

In an eighth variation of the third aspect, the barcode array 4 further includes a top position barcode pattern 19 that is arranged to be used by the process 500 to identify the media elevator 1's current position as being an included top position 8.9.

In a ninth variation of the third aspect, the barcode array 4 further includes one or more intermediate position barcode patterns 15 that are used by the process 500 to identify the media elevator 1's current position as being one or more included intermediate positions 8.5.

Also, there is described the fourth aspect of the invention, namely, a media handling device 600 including a recorded information 110 disposed in an included movable media elevator 101, further including media elevator's current position identifying sensing means 130 fixed proximate to a generally-vertical media elevator travel path 8, the recorded information 110 being arranged to be sensed to form 503 a detected information which, in turn, is used by included processing means 50 to identify 505 the media elevator's current position.

In a first variation of the fourth aspect, the one or more sensors 130 includes a bottom position sensor 131 that is arranged to be used by the process 500 to identify the media elevator 101's current position as being an included bottom position 8.1.

In a second variation of the fourth aspect, the one or more sensors 130 includes a top position sensor 139 that is arranged to be used by the process 500 to identify the media elevator 101's current position as being an included top position 8.9.

In a third variation of the fourth aspect, the one or more sensors 130 includes one or more intermediate position sensors 135 that are arranged to be used by the process 500 to identify the media elevator 101's current position as being one or more included intermediate positions 8.5.

The table below lists the drawing element reference numbers together with their corresponding written description:

| No.: | Description: |
|---|---|
| 1 | media elevator |
| 1' | media elevator in media elevator travel path bottom position 8.1 |
| 2 | media stack |
| 3 | surface |
| 4 | recorded information array, barcode array |
| 8 | media elevator travel path |
| 8.1 | media elevator travel path bottom position |
| 8.5 | media elevator travel path intermediate position(s) |
| 8.9 | media elevator travel path top position |
| 10 | recorded information |
| 10.1 | barcode symbols |
| 11 | travel path bottom position recorded information |
| 15 | travel path intermediate position(s) recorded information |
| 19 | travel path top position recorded information |
| 29 | sensing signal |
| 30 | sensor |
| 49 | sensor output |
| 50 | processing means |
| 100 | media handling device |
| 101 | media elevator |
| 101' | media elevator in media elevator travel path bottom position 8.1 |
| 104 | sensor array |
| 121 | sensing signal |
| 125 | sensing signal |
| 129 | sensing signal |
| 130 | sensor(s) |
| 131 | travel path bottom position sensor |
| 135 | travel path intermediate position(s) sensor(s) |
| 139 | travel path top position sensor |
| 141 | bottom position sensor output |
| 145 | intermediate position(s) sensor(s) output(s) |
| 149 | top position sensor output |
| 500 | media elevator's current position identification method |
| 501 | start |
| 503 | detecting |
| 505 | identify position |
| 507 | end |
| 600 | media handling device |

While particular embodiments have been described hereinabove, alternatives, modifications, variations, improvements and substantial equivalents that are or may be presently unforeseen may arise to applicants or others skilled in the art. Accordingly, the appended claims as filed and as they may be amended are intended to embrace all such alternatives, modifications, variations, improvements and substantial equivalents.

What is claimed is:

1. A method to identify a media elevator's current position in a generally-vertical travel path proximate to a fixed surface of a media handling device, the method comprising:

detecting, using a sensor on said media elevator, recorded information that is disposed in the fixed surface proximate to the generally-vertical travel path of the media elevator, thus forming detected information; and identifying the media elevator's current position, relative to the fixed surface, based on the sensor detecting recorded information: associated with a bottom position of the generally-vertical travel path, associated with one or more quanta of intermediate positions of the generally-vertical travel path, and associated with a top position of the generally-vertical travel path.

2. The method of claim 1, the recorded information including a bottom position recorded information arranged to identify the media elevator's current position as an included bottom position.

3. The method of claim 2, the recorded information including a top position recorded information arranged to identify the media elevator's current position as an included top position.

4. The method of claim 3, the recorded information including one or more quanta of intermediate position recorded information arranged to identify the media elevator's current position as one or more included intermediate positions.

5. The method of claim 1, the recorded information including one or more machine-detectable symbols.

6. The method of claim 5, the machine-detectable symbols being arranged to be detected by any of magnetic signals, radio signals, infrared signals, machine vision, optical signals or ultrasonic signals.

7. The method of claim 5, the recorded information comprising one or more barcode symbols.

8. The method of claim 7, the barcode symbols comprising a barcode array, the barcode array including a bottom position barcode pattern arranged to identify the media elevator's current position as an included bottom position.

9. The method of claim 8, the barcode array further including a top position barcode pattern arranged to identify the media elevator's current position as an included top position.

10. The method of claim 9, the barcode array further including one or more intermediate position barcode patterns arranged to identify the media elevator's current position as one or more included intermediate positions.

11. A method to identify a media elevator's current position in a media handling device, the method comprising:

detecting, by multiple sensors, recorded information that is located on the media elevator, which moves in a generally-vertical path proximate to a fixed surface of the media handling device, thus forming detected information; and identifying the media elevator's current position based on: a bottom position sensor that detect the recorded information from the media elevator when the media elevator is located at a bottom position of the generally-vertical travel path, one or more intermediate sensors that detect the recorded information from the media elevator when the media elevator is located at one or more intermediate positions of the generally-vertical travel path, and a top position sensor that detects the recorded information from the media elevator when the media elevator is located at a top position of the generally-vertical travel path.

12. The method of claim 11, the multiple sensors including a bottom position sensor arranged to identify the media elevator's current position as an included bottom position.

13. The method of claim 12, the multiple sensors including a top position sensor arranged to identify the media elevator's current position as an included top position.

14. The method of claim 13, the multiple sensors including one or more intermediate position sensors arranged to identify the media elevator's current position as one or more included intermediate positions.

15. A media handling device comprising:

a media elevator's current position sensor disposed on a media elevator, the media elevator being movable in a generally-vertical travel path proximate to a fixed surface of the media handling device that includes recorded information disposed on the fixed surface, the recorded information being sensed by said current position sensor to form detected information; and a processor that uses said detected information to identify the media elevator's current position along the generally-vertical travel path, based on the current position sensor detecting recorded information from the fixed surface associated with: a bottom position of the generally-vertical travel path, one or more quanta of intermediate positions of the generally-vertical travel path, and a top position of the generally-vertical travel path, wherein the detected information comprises magnetic signals disposed on the fixed surface that correspond to each of the bottom, one or more intermediate, and top positions of the generally-vertical travel path of the media elevator.

16. The media handling device of claim 15, the recorded information including a bottom position recorded information arranged to identify the media elevator's current position as an included bottom position.

17. The media handling device of claim 16, the recorded information including a top position recorded information arranged to identify the media elevator's current position as an included top position.

18. The media handling device of claim 17, the recorded information including one or more quanta of intermediate position recorded information arranged to identify the media elevator's current position as one or more included intermediate positions.

19. The media handling device of claim 15, the recorded information including one or more magnetically-detectable symbols.

20. The media handling device of claim 19, the recorded information comprising one or more magnetically-detectable barcode symbols.

21. The media handling device of claim 20, the magnetically-detectable barcode symbols comprising a barcode array, the barcode array including a bottom position barcode pattern arranged to identify the media elevator's current position as an included bottom position.

22. The media handling device of claim 21, the barcode array further including a top position barcode pattern arranged to identify the media elevator's current position as an included top position.

23. The media handling device of claim 22, the barcode array further including one or more intermediate position barcode patterns arranged to identify the media elevator's current position as one or more included intermediate positions.

24. A media handling device comprising:

recorded information disposed on a media elevator being movable in a generally-vertical travel path proximate to a fixed surface of the media handling device;

multiple sensors disposed on the fixed surface proximate to the generally-vertical travel path of the media elevator, the recorded information disposed on the media elevator being sensed by the multiple sensors to form detected information;

a processor that uses said detected information to identify the media elevator's current position based on: a bottom position sensor that detects the recorded information from the media elevator when the media elevator is located at a bottom position of the generally-vertical travel path, one or more intermediate sensors that detect the recorded information from the media elevator when the media elevator is located at one or more intermediate positions of the generally-vertical travel path, and a top position sensor that detects the recorded information from the media elevator when the media elevator is located at a top position of the generally-vertical travel path, wherein the detected information comprises a magnetic signal from the media elevator that is detected by the bottom, the one or more intermediate, and the top position sensors disposed along the fixed surface and proximate to the generally-vertical travel path of the media elevator.

25. The media handling device of claim 24, the multiple sensors including a bottom position sensor arranged to identify the media elevator's current position as an included bottom position.

26. The media handling device of claim 25, the multiple sensors including a top position sensor arranged to identify the media elevator's current position as an included top position.

27. The media handling device of claim 26, the multiple sensors including one or more intermediate position sensors arranged to identify the media elevator's current position as one or more included intermediate positions.

* * * * *